US007123194B2

(12) United States Patent
Park et al.

(10) Patent No.: US 7,123,194 B2
(45) Date of Patent: Oct. 17, 2006

(54) ROTATABLE MICROSTRIP PATCH ANTENNA AND ARRAY ANTENNA USING THE SAME

(75) Inventors: Ung-Hee Park, Daejon (KR); Haeng-Sook Ro, Daejon (KR); Soon-Ik Jeon, Daejon (KR)

(73) Assignee: Electronics and Telecommunications Research Institute, (KR)

( * ) Notice: Subject to any disclaimer, the term of this patent is extended or adjusted under 35 U.S.C. 154(b) by 0 days.

(21) Appl. No.: 11/026,455

(22) Filed: Dec. 30, 2004

(65) Prior Publication Data

US 2006/0044190 A1 Mar. 2, 2006

(30) Foreign Application Priority Data

Sep. 1, 2004 (KR) ..... 10-2004-0069439

(51) Int. Cl.
*H01Q 1/38* (2006.01)

(52) U.S. Cl. ..... 343/700 MS

(58) Field of Classification Search ..... 343/700 MS, 343/829, 846

See application file for complete search history.

(56) References Cited

U.S. PATENT DOCUMENTS 5,210,542 A * 5/1993 Pett et al. ..... 343/700 MS
5,661,498 A * 8/1997 Goto et al. ..... 343/771
5,929,819 A * 7/1999 Grinberg ..... 343/754
5,933,120 A * 8/1999 Manasson et al. ..... 343/788

FOREIGN PATENT DOCUMENTS

KR 10-0262758 5/2000
KR 10-2002-0041771 6/2002

OTHER PUBLICATIONS

A. Dhouib, et al., Experimental and Numerical Analysis of a Microstrip/Stripline-Coupling Scheme for Multi-Layer Planar Antennas, Antennas and Propagation Society International Symposium, vol. 3, pp. 1718-1721, Jun. 1994.

* cited by examiner

*Primary Examiner*—Tho Phan
(74) *Attorney, Agent, or Firm*—Blakely Sokoloff Taylor & Zafman

(57) ABSTRACT

A rotatable microstrip patch antenna and an array antenna using the same is disclosed. A rotatable microstrip patch antenna, includes: a first substrate layer capable of being predetermined angle rotated toward a predetermined direction for inputting and outputting a transmitting/receiving signal; a second substrate layer arranged bottom of the first substrate layer with a predetermined distance space for transmitting and receiving signals to/from the first substrate layer; and a signal transferring unit for allowing a rotation of the first substrate layer and transferring the signals between the first substrate layer and the second substrate layer.

24 Claims, 5 Drawing Sheets

ROTATABLE MICROSTRIP PATCH ANTENNA AND ARRAY ANTENNA USING THE SAME

FIELD OF THE INVENTION

The present invention relates to a rotatable microstrip patch antenna and an array antenna using the same; and, more particularly, to a rotatable microstrip patch antenna for improving a polarization characteristic for transmitting and receiving signals and an array antenna using the same.

DESCRIPTION OF RELATED ARTS

FIG. 1A is a perspective view illustrating a conventional antenna using a rotatable antenna element, and FIG. 1B is a diagram showing a conventional rotatable microstrip patch antenna having a plurality of signal transmission lines.

Generally, when a rotation mechanism is required for an antenna, the antenna is designed to have two independent units, one for transmitting signal and other for receiving signal. Also, the antenna providing the rotation mechanism is designed by using a horn antenna 10 which is a rotatable antenna element is shown in FIG. 1A. Furthermore, the antenna is designed to include a plurality of signal transmission lines for selecting one of the signal transmission lines according to rotation of the antenna as shown in FIG. 1B.

In case of a microstrip patch antenna 20 for transmitting and receiving signal using a substrate layer, the rotational mechanism is not appropriate to be implemented. Therefore, a plurality of signal transmission lines 21 is included in the microstrip patch antenna as shown in FIG. 1B for supporting transmission of signals according to a rotation of an antenna. That is, the microstrip patch antenna 20 selects one of the signal transmission lines 21 for receiving and transmitting signals by using a signal selector 22 according to a rotation angle.

However, the performance of antenna cannot be optimized by the above mentioned structures of the microstrip patch antenna having a plurality of the signal transmission lines. Also, it is very hard to integrate, manufacture and assemble the microstrip patch antenna having a plurality of the signal transmission lines. Furthermore, a signal may be attenuated a lot and it cannot be implemented to the various super high frequency circuits.

SUMMARY OF THE INVENTION

It is, therefore, an object of the present invention to provide a rotatable microstrip patch antenna transmitting signals without changing of signal characteristics by using a cable or an electromagnetic coupling.

It is another object of the present invention to provide a rotatable microstrip patch antenna for transmitting signals with low loss by using a cable or an electromagnetic coupling.

It is another object of the present invention to provide a rotatable microstrip patch antenna easy to be manufactured and integrated by using a cable or an electromagnetic coupling.

In accordance with an aspect of the present invention, there is also provided a rotatable microstrip patch antenna, including: a first substrate layer capable of being predetermined angle rotated toward a predetermined direction for inputting and outputting a transmitting/receiving signal; a second substrate layer arranged bottom of the first substrate layer with a predetermined distance space for transmitting and receiving signals to/from the first substrate layer; and a signal transferring unit for allowing a rotation of the first substrate layer and transferring the signals between the first substrate layer and the second substrate layer.

In accordance with another aspect of the present invention, there is also provided an array antenna using a rotatable microstrip patch antenna, including: a plurality of radiation elements capable of being predetermined angel rotated toward a predetermined direction for transmitting and receiving a super high frequency signal; and a rotation operator for rotating the radiation elements with a predetermined angle, wherein the radiation elements includes: a first substrate layer capable of being a predetermined angel rotated toward a predetermined direction for inputting and outputting a transmitting/receiving signal; a second substrate layer arranged bottom of the first substrate layer within a predetermined space for transmitting and receiving signals to/from the first substrate layer; and a signal transferring unit for allowing a rotation of the first substrate layer and transferring the signals between the first substrate layer and the second substrate layer.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a rotatable microstrip patch antenna and an array antenna using the same in accordance with a preferred embodiment of the present invention will be described in more detail with reference to the accompanying drawings.

Figure 1A:
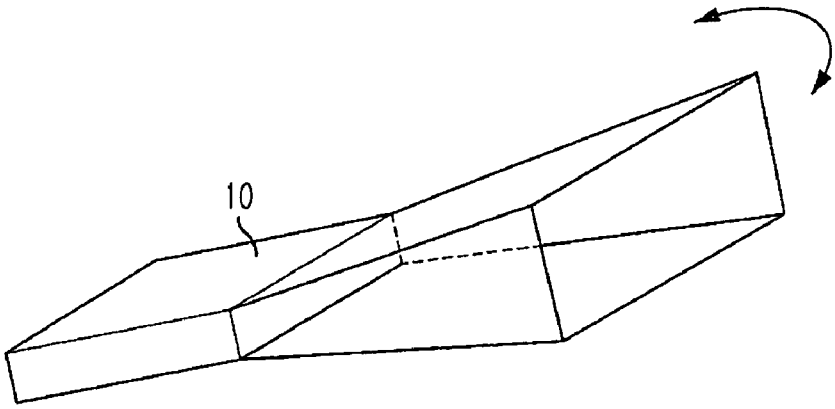
FIG. 1A (PRIOR ART)
FIG. 1A is a perspective view illustrating a conventional antenna using a rotatable antenna element.
Figure 1B:
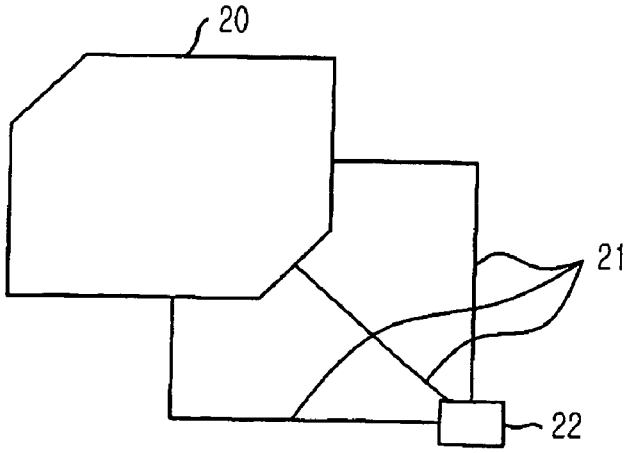
FIG. 1B (PRIOR ART)
FIG. 1B is a diagram showing a conventional rotatable microstrip patch antenna having a plurality of signal transmission lines.
Figure 2:
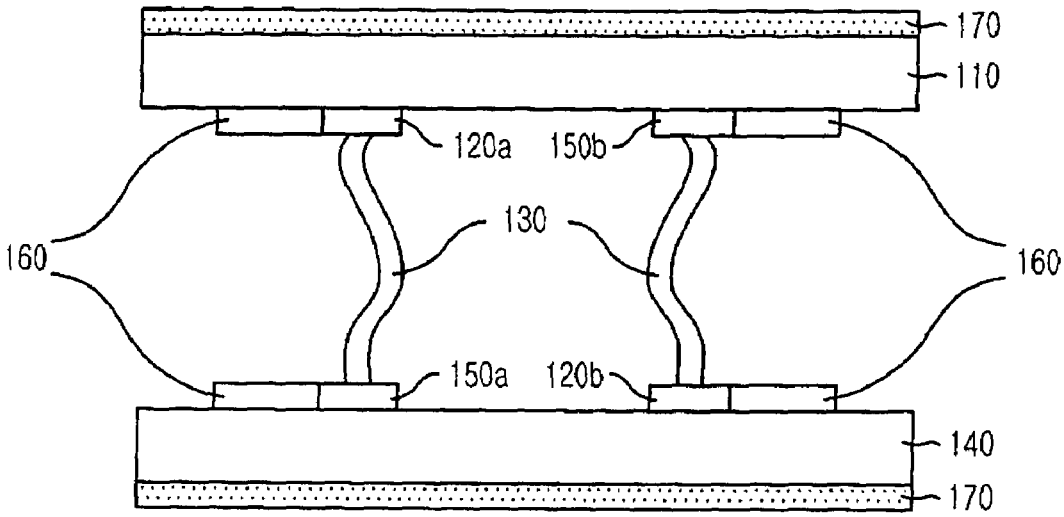
FIG. 2 is a rotatable microstrip patch antenna having a cable transmission line in accordance with a preferred embodiment of the present invention.

FIG. 2 is a rotatable microstrip patch antenna having a cable transmission line in accordance with a preferred embodiment of the present invention.

As shown in FIG. 2, the rotatable microstrip patch antenna having the cable transmission lines includes a first substrate layer 110 having a rotatable microstrip structure and a second substrate layer 140 having a fixed microstrip structure. The first substrate layer 110 includes a ground layer 170, a super high frequency transmission line 160, a first input terminal 120*a* and a first output terminal 150*b*. Also, the second substrate layer 140 includes a ground layer 170, a super high frequency transmission line 160, a second output terminal 150*a* and a second input terminal 120*b*. The first substrate layer 110 and the second substrate layer 140 are electrically connected by a coaxial cable 130.

In more detail, the first substrate layer 110 is predetermined angle rotatable toward a predetermined direction. The first input terminal 120*a* receives a super high frequency signal for transmitting. The first output terminal 150*b* outputs a super high frequency signal received from the antenna. The ground layer 170 is formed on top of the first substrate layer 110.

The second substrate layer 140 has a microstrip patch structure which is not rotatable and is separated from the first substrate layer 110 with a predetermined distance. The second output terminal 150*a* of the second substrate layer 140 is connected to the first input terminal 120*a* of the first substrate layer 140 through the coaxial cable 130 and outputs the super high frequency to the input terminal 120*a* through the coaxial cable 130. The second input terminal 120*b* of the second substrate layer 140 is connected to the first output terminal 150*b* of the first substrate layer 110 by the coaxial cable 130 and receives the super high frequency from the first output unit 150*b* through the coaxial cable 130. That is, the coaxial cable 130 transfers super high frequency signals between the first input terminal 120*a* and the second output terminal 150*a*, and between the first output terminal 150*b* and the second input terminal 120*b*. The ground layer 170 is formed on bottom of the second substrate layer 140.

The super high frequency transmission line 160 connects the first input terminal 120*a* to the second output terminal 150*a* and connects the first output terminal 150*b* to the second input terminal 120*b* for transferring the super high frequency signals between the first substrate layer 110 and the second substrate layer 140. The super high frequency transmission line 160 has a predetermined shape such as a ring, a disk and a sliced ring.

Furthermore, it is obvious to skilled in the art that the input terminals 120*a* and 120*b* can be operated as output terminals and the output terminals 150*b* and 150*a* also can be used as input terminals.

A received signal from the first input terminal 120*a* is transferred to the second output terminal 150*a* through the coaxial cable 130 having a predetermined length corresponding to a maximum allowable range of a rotation angle. A transmitted signal from the first output terminal 150*b* is transferred to the second input terminal 120*b* through the coaxial cable 130 having a predetermined length corresponding to a maximum allowable range of a rotation angle.

Therefore, the rotatable microstrip patch antenna having a cable transmission line can continuously transmit signals having constant characteristics although a rotational angel or device arrangement is changed.

Figure 3:
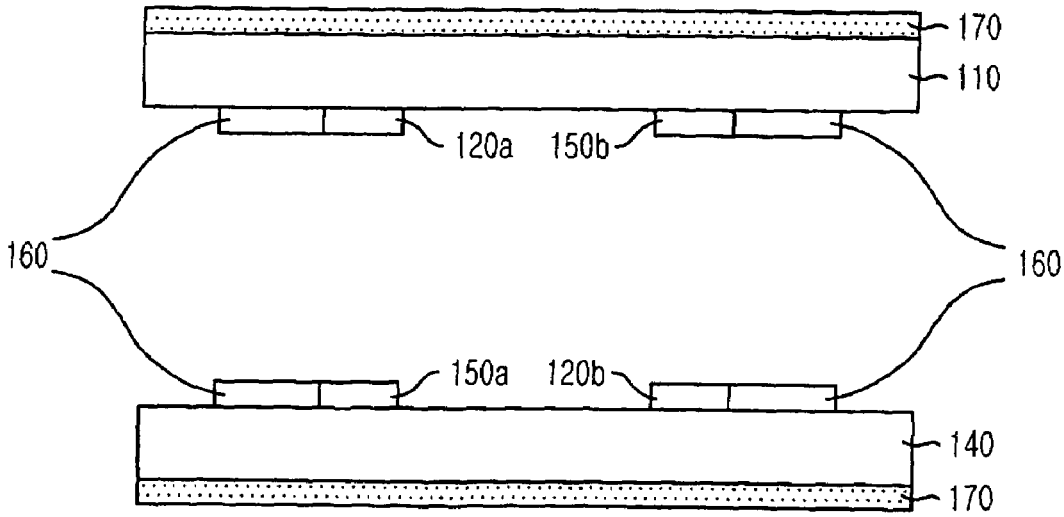
FIG. 3 is a rotatable microstrip patch antenna having a transmission line using an electromagnetic coupling in accordance with a preferred embodiment of the present invention.

FIG. 3 is a rotatable microstrip patch antenna having a transmission line using an electromagnetic coupling in accordance with a preferred embodiment of the present invention.

As shown in FIG. 3, the rotatable microstrip patch antenna having the transmission line using the electromagnetic coupling has a structure identical to the rotatable microstrip patch antenna of FIG. 2 excepting the coaxial cable 130. That is, the rotatable microstrip patch antenna having the transmission line using the electromagnetic coupling of FIG. 3 includes the cable transmission lines includes a first substrate layer 110 having a rotatable microstrip structure and a second substrate layer 140 having a fixed microstrip structure. The first substrate layer 110 includes a ground layer 170, a super high frequency transmission line 160, a first input terminal 120*a* and a first output terminal 150*b*. Also, the second substrate layer 140 includes a ground layer 170, a super high frequency transmission line 160, a second output terminal 150*a* and a second input terminal 120*b*. The first substrate layer 110 and the second substrate layer 140 are electrically connected by electromagnetic coupling of the super high frequency transmission line 160. Therefore, detailed explanations of identical components are omitted here.

In comparison with the rotatable microstrip patch antenna of FIG. 2, the rotatable microstrip patch antenna of the FIG. 3 uses the electromagnetic coupling of the super high frequency transmission line 160 for electrically connecting the first substrate layer 110 and the second substrate layer 140. In more detail, the first input unit 120*a* is connected to the second output unit 150*a* through the electromagnetic coupling generated between the super high frequency transmission line 160 of the first substrate layer 110 and other super high frequency transmission lien 160 of the second substrate layer 140. Also, the first output unit 150*b* is connected to the second input unit 120*b* through the electromagnetic coupling of the super high frequency transmission lines 160. The super high frequency transmission line 160 has a predetermined shape such as a ring, a disk and a sliced ring.

The first input end 120*a* of the first substrate layer transfers a signal to the second output end 150*a* of the second substrate layer 140 through the electromagnetic coupling. And, the second output end 150*b* of the first substrate layer transfers 110 transfers a signal to the second input end 120*b* of the second substrate layer 140 through the electromagnetic coupling.

For providing the electromagnetic coupling, the super high frequency lines 160 of both substrate layers 110 and 140 have identical shape and size, and are arranged with an overlapped manner based on a vertical plane. Therefore, although the first substrate layer 110 is rotated, the signal can be continuously transferred to the second substrate layer 140 without variation of signal characteristics. The super high transmission line 160 will be explained in detailed by referring to FIGS. 4 to 6.

Figure 4:
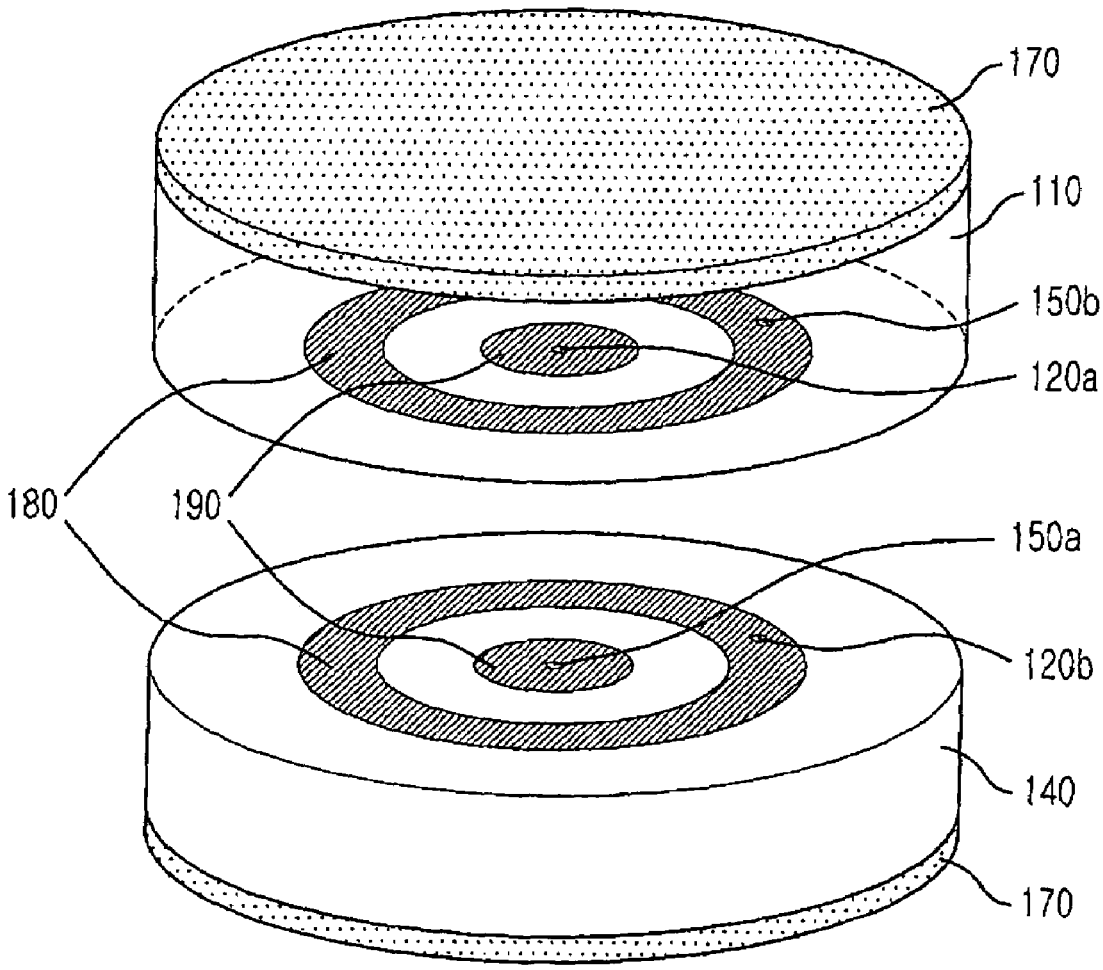
FIG. 4 is a perspective view of a 360° rotatable microstrip patch antenna having a super high frequency transmission line having a ring shape in accordance with a preferred embodiment of the present invention.

FIG. 4 is a perspective view of a 360° rotatable microstrip patch antenna having a super high frequency transmission line having a ring shape in accordance with a preferred embodiment of the present invention. That is, FIG. 4 shows a super high frequency transmission circuit using input or output terminals formed on the ring shape of the super high frequency transmission line and a circular shape patch.

As shown in FIG. 4, a first input terminal 120*a* is formed on the circular shape patch 190 of a first substrate 110, where the circular shape patch 190 is a circular plate patch structure. Also, the second output end 150*a* is formed on the circular shape patch 190 having a predetermined diameter in a second substrate layer 140. The first input terminal 120*a* is indirectly connected to the second output terminal 150*a* by an electromagnetic coupling, and the first input terminal 120*a* transfers the signal to the second output terminal 150*a* through the electromagnetic coupling connection.

Also, a second output terminal 150*b* is formed on a ring shape transmission line 180 of the first substrate layer 110. And a second input terminal is formed on a ring shape transmission line 180 of the second substrate layer 140. The ring shape transmission line 180 is a hollow circle plate shape of a patch structure. The second output terminal 150*b* is electromagnetically coupled to the second input terminal 120*b*, and the second output terminal 150*b* transfers the signal to the second input terminal 120*b* through the electromagnetic coupling connection.

A thickness of the ring shape transmission line 180 and the circular shape transmission lien 190 are determined according to an operation frequency, characteristics of substrate and impedance matching between the input/output terminals.

Figure 5:
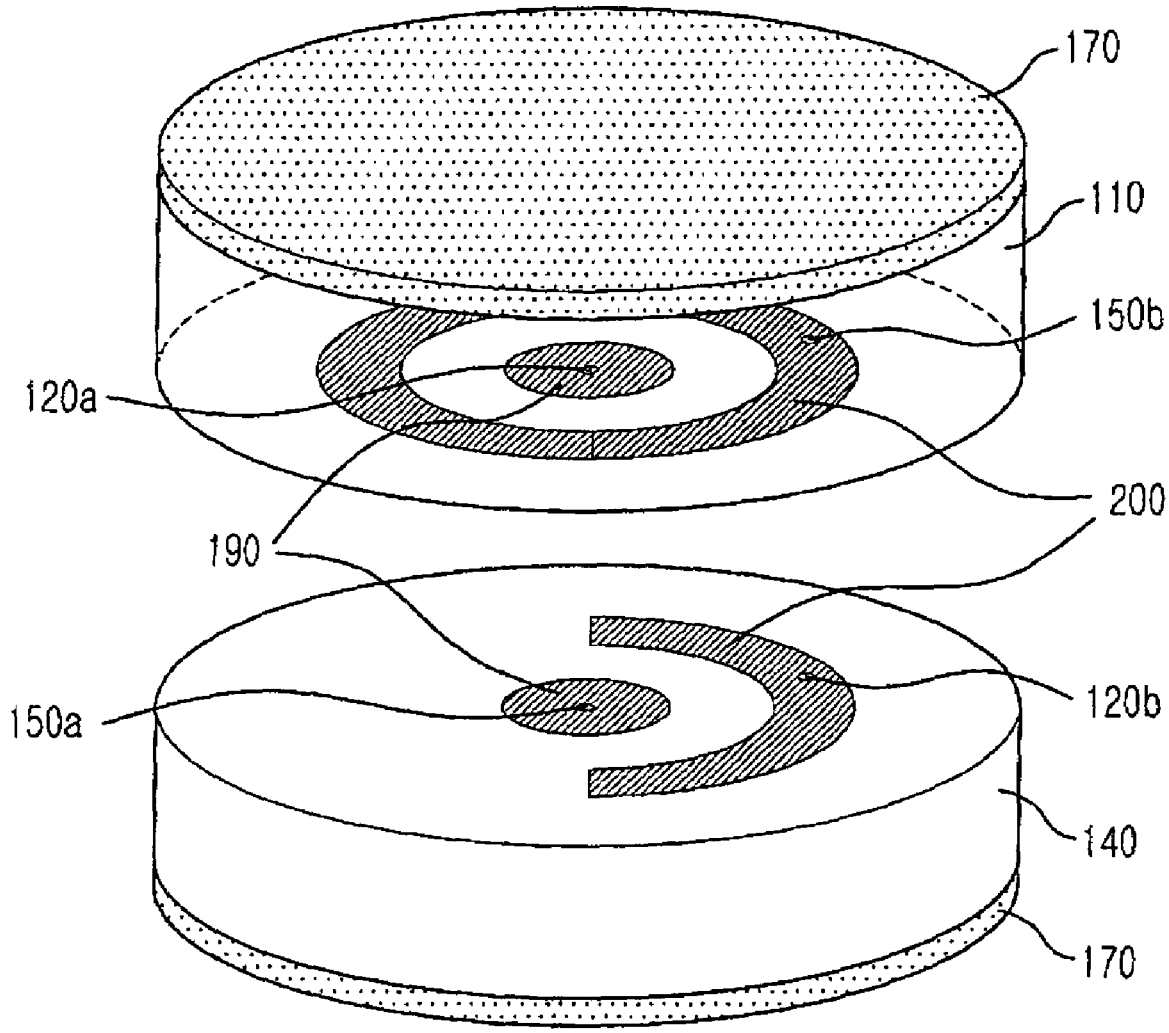
FIG. 5 is a perspective view of a rotatable microstrip patch antenna having a sliced ring shape transmission line capable of rotating within a predetermined angle in accordance with a preferred embodiment of the present invention.

FIG. 5 is a perspective view of a rotatable microstrip patch antenna having a sliced ring shape transmission line capable of rotating within a predetermined angle in accordance with a preferred embodiment of the present invention.

As shown in FIG. 5, a first output terminal 150*b* is connected to a sliced ring shape transmission line 200 having a shape of a predetermined part sliced from the ring shape transmission line 180 included in a first substrate layer 110. And a second input terminal 120*b* is connected to a sliced ring shape transmission 200 having a shape of a predetermined part sliced from the ring shape transmission line 180 included in a second substrate layer 140. The first output terminal 150*b* is indirectly connected to the second input terminal 120*b* by an electromagnetic coupling, and the first output terminal 150*b* transfers a signal to the second input end 120 through the electromagnetic coupling.

An angel of arc inside and outside of the sliced ring shape transmission line 200 is determined according to a maximum allowable range of rotation angel between the first substrate layer 110 which is a rotatable layer and the second substrate layer 140 which is a fixed layer.

Figure 6:
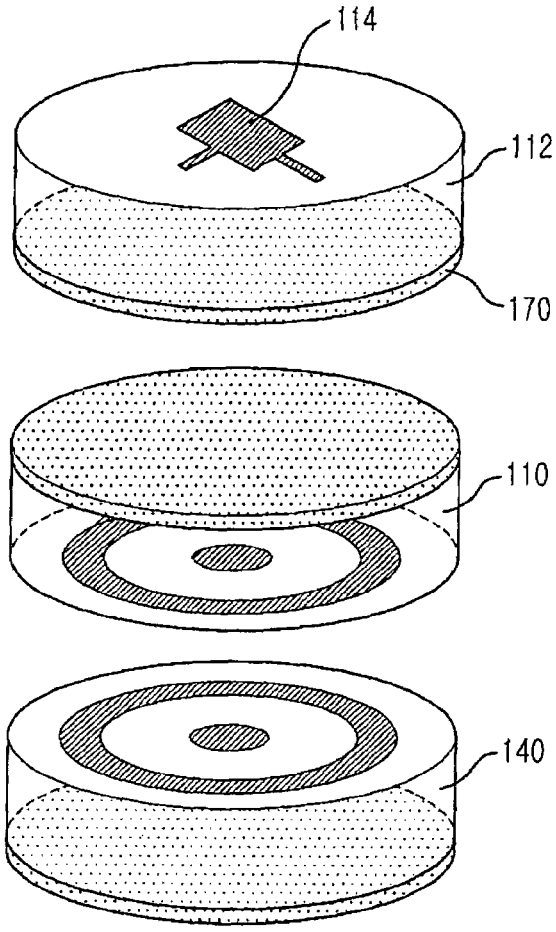
FIG. 6 is a perspective view showing a rotatable microstrip patch antenna including a third substrate layer in accordance with still another preferred embodiment of the present invention.

FIG. 6 is a perspective view showing a rotatable microstrip patch antenna including a third substrate layer in accordance with still another preferred embodiment of the present invention.

The rotatable microstrip patch antenna of FIG. 6 includes the first substrate layer 110 and the second substrate layer 140 shown in FIG. 4. The rotatable microstrip patch antenna of FIG. 6 further includes a third substrate layer 112 having a transmitting/receiving feeding unit 114 on top of the first substrate layer 110. The transmitting/receiving feeding unit 114 is an integrated circuit having two feeding ports.

The preferred embodiment of the present invention in FIG. 6 includes the third substrate layer with the rotatable microstrip patch antenna shown in FIG. 4. However, it is obvious to skilled in the art that the third substrate layer shown in FIG. 6 can be included in the embodiments of FIGS. 2 and 5 for embodying the rotatable microstrip patch antenna.

The third substrate layer 112 includes the transmitting/receiving feeding unit 114 having two transmission lines for transmitting and receiving, a ground layer 170 formed on bottom of substrate layer and a microstrip structure pattern on the substrate layer. The third substrate layer 112 has an antenna function capable of transmitting and receiving a signal.

The third substrate 112 is coupled to the first substrate layer 110 through the ground layer 170 and the antenna characteristics of the third substrate 112 does not influence to a signal transmission line of the second substrate layer 140. Accordingly, a signal is stably transmitted when the first substrate layer 110 is rotated to a predetermined angle because the first substrate layer 110 is arranged to be separated from the second substrate layer 140 within a predetermined distance.

Figure 7:
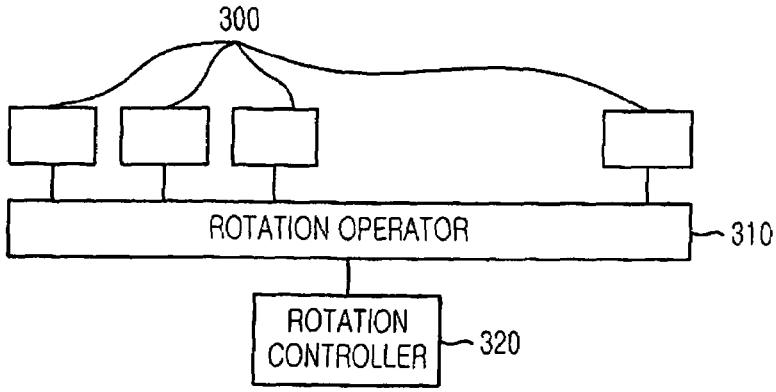
FIG. 7 is a diagram illustrating an array antenna using a rotatable microstrip patch antenna in accordance with a preferred embodiment of the present invention.

FIG. 7 is a diagram illustrating an array antenna using a rotatable microstrip patch antenna in accordance with a preferred embodiment of the present invention.

As shown in FIG. 7, the array antenna includes a plurality of rotatable microstrip patch antennas for improving a polarization characteristic in accordance with a preferred embodiment of the present invention.

That is, the array antenna include a plurality of rotatable radiation elements 300 which is the rotatable microstrip patch antenna of the present invention, a rotation operator 310 electrically connected to each of the rotatable radiation elements 300 for rotating the rotatable radiation elements 300 and a rotation controller 320 for controlling the rotation operator 310 for rotating the rotatable radiation elements 300.

When each of rotatable radiation elements 300 is required to be rotated in the array antenna, the rotation operator 310 rotates each of the rotatable radiation elements 300 based on a control of the rotation controller 320.

As mentioned above, the rotatable microstrip patch antenna of present invention can suppress variation of super high frequency characteristics generated by rotation of the antenna when the patch antenna is rotated for reducing a polarization loss generated by change of satellite location and antenna location. Also, the rotatable microstrip patch antenna of the present invention has advantages of easy manufacturing and high integration.

Furthermore, in the rotatable microstrip patch antenna of the present invention, signals are transferred between two pairs of input and output terminals where the input terminal and the output terminal are formed on two different substrate layers. Therefore, the rotatable microstrip patch antenna can be implemented for rotating one of substrate layers or rotating both of the substrate layers. Also, the rotatable microstrip patch antenna continuously transfers energy without a signal attenuation or a signal cutoff while rotating the input/output terminals and the transmission lines connecting the input/output terminals. Moreover, the optimized polarization characteristics can be achieved by maintaining the reliability of the patch antenna while rotating the rotatable microstrip patch antenna.

The present application contains subject matter related to Korean patent application No., filed in the Korean patent office on, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A rotatable microstrip patch antenna, comprising:

a first substrate layer capable of being predetermined angle rotated toward a predetermined direction for inputting and outputting a transmitting/receiving signal;

a second fixed substrate layer arranged below the first substrate layer with a predetermined distance space for transmitting and receiving signals to/from the first substrate layer; and a signal transferring unit for allowing a rotation of the first substrate layer and transferring the signals between the first substrate layer and the second substrate layer.

2. The rotatable microstrip patch antenna as recited in claim 1, further comprising:

a third substrate layer being connected to the first substrate layer through a ground layer including a transmitting/receiving feeding unit for being operated as an antenna for transmitting and receiving signals.

3. The rotatable microstrip patch antenna as recited in claim 2, wherein the first substrate layer includes:

a first input terminal for receiving a transmitting signal;

a first output terminal for outputting a receiving signal;

a first transmission line of the first substrate layer connected to the first input end for providing a super high frequency signal transmission path; and a second transmission line of the first substrate layer connected to the first output terminal for providing a super high frequency signal transmission path, wherein the second substrate layer includes:

a second output terminal for outputting a signal to the first input terminal;

a second input terminal for receiving a signal from the first output terminal;

a first transmission line of the second substrate layer connected to the second output terminal for providing a super high frequency signal transmission path; and a second transmission line of the second substrate layer connected to the second input terminal for providing a super high frequency signal transmission path.

4. The rotatable microstrip patch antenna as recited in claim 3, wherein the signal transferring unit is a coaxial cable.

5. The rotatable microstrip patch antenna as recited in claim 3, wherein the signal transferring unit uses an electromagnetic coupling between the first transmission line of the first substrate layer and the first transmission line of the second substrate layer, and uses an electromagnetic coupling between the second transmission line of the first substrate layer and the second transmission line of the second substrate layer.

6. The rotatable microstrip patch antenna as recited in claim 5, wherein the first transmission line of the first substrate layer and the first transmission line of the second substrate layer have identical type and same size of a microstrip patch structure, and are arranged in vertically overlapped position, and the second transmission line of the first substrate layer and the second transmission line of the second substrate layer has identical type and same size of a microstrip patch structure, and are arranged in vertically overlapped position.

7. The rotatable microstrip patch antenna as recited in claim 6, wherein the second transmission line of the first substrate layer and the second transmission line of the second substrate layer are a circular shape transmission line.

8. The rotatable microstrip patch antenna as recited in claim 6, wherein the first transmission line of the first substrate layer and the first transmission line of the second substrate layer are a ring shape transmission line.

9. The rotatable microstrip patch antenna as recited in claim 6, wherein the first transmission line of the first substrate layer and the first transmission line of the second substrate layer are a sliced ring shape transmission line.

10. The rotatable microstrip patch antenna as recited in claim 5, wherein the first transmission line of the first substrate layer and the first transmission line of the second substrate layer have identical type and same size of a microstrip patch structure, and are arranged in vertically overlapped position, and the second transmission line of the first substrate layer and the second transmission line of the second substrate layer has identical type and same size of a microstrip patch structure, and are arranged in vertically overlapped position.

11. The rotatable microstrip patch antenna as recited in claim 10, wherein the second transmission line of the first substrate layer and the second transmission line of the second substrate layer are a circular shape transmission line.

12. The rotatable microstrip patch antenna as recited in claim 10, wherein the first transmission line of the first substrate layer and the first transmission line of the second substrate layer are a ring shape transmission line.

13. The rotatable microstrip patch antenna as recited in claim 10, wherein the first transmission line of the first substrate layer and the first transmission line of the second substrate layer are a sliced ring shape transmission line.

14. An array antenna using a rotatable microstrip patch antenna, comprising:

a plurality of radiation elements capable of being predetermined angle rotated toward a predetermined direction for transmitting and receiving a super high frequency signal; and a rotation operator for rotating the radiation elements with a predetermined angle, wherein the radiation elements includes: a first substrate layer capable of being a predetermined angle rotated toward a predetermined direction for inputting and outputting a transmitting/receiving signal;

a second fixed substrate layer arranged below the first substrate layer within a predetermined space for transmitting and receiving signals to/from the first substrate layer; and a signal transferring unit for allowing a rotation of the first substrate layer and transferring the signals between the first substrate layer and the second substrate layer.

15. The array antenna as recited in claim 14, wherein the signal transferring unit is a coaxial cable.

16. The array antenna as recited in claim 14, wherein the signal transferring unit uses an electromagnetic coupling between the a super high signal transmission line of the first substrate layer and a super high signal transmission line of the second substrate layer.

17. The array antenna as recited in claim 16, wherein the super high frequency transmission line of the first substrate layer and the super high frequency transmission line of the second substrate layer have an identical type microstrip patch structure and a same size, and are arranged in a vertical overlapped position.

18. The array antenna as recited in claim 17, wherein the super high transmission line of the first substrate layer and the super high transmission line of the second substrate layer are a ring shape or a sliced ring shape.

19. A rotatable microstrip patch antenna, comprising:

a first substrate layer configured to be predetermined angle rotated toward a predetermined direction for inputting and outputting a transmitting/receiving signal wherein the first substrate layer comprises (a) a first input terminal for receiving a transmitting signal (b) a first output terminal for outputting a receiving signal, (c) a first transmission line of the first substrate layer connected to the first input end for providing a super high frequency signal transmission path and (d) a second transmission line of the first substrate layer connected to the first output terminal for providing a super high frequency signal transmission path;

a second substrate layer arranged bottom of the first substrate layer with a predetermined distance space for transmitting and receiving signals to/from the first substrate layer wherein the second substrate layer comprises (a) a second output terminal for outputting a signal to the first input terminal, (b) a second input terminal for receiving a signal from the first output terminal, (c) a first transmission line of the second substrate layer connected to the second output terminal for providing a super high frequency signal transmission path, and (d) a second transmission line of the second substrate layer connected to the second input terminal for providing a super high frequency signal transmission path;

a signal transferring unit for allowing a rotation of the first substrate layer and transferring the signals between the first substrate layer and the second substrate layer; and a third substrate layer being connected to the first substrate layer through a ground layer including a transmitting/receiving feeding unit for being operated as an antenna for transmitting and receiving signals.

20. The rotatable microstrip patch antenna as recited in claim 19, wherein the signal transferring unit is a coaxial cable.

21. The rotatable microstrip patch antenna as recited in claim 19, wherein the signal transferring unit uses an electromagnetic coupling between the first transmission line of the first substrate layer and the first transmission line of the second substrate layer, and uses an electromagnetic coupling between the second transmission line of the first substrate layer and the second transmission line of the second substrate layer.

22. An array antenna using a rotatable microstrip patch antenna, comprising:

a plurality of radiation elements configured to be predetermined angle rotated toward a predetermined direction for transmitting and receiving a super high frequency signal, wherein the radiation elements includes:

(a) a first substrate layer capable of being a predetermined angle rotated toward a predetermined direction for inputting and outputting a transmitting/receiving signal;

(b) a second substrate layer arranged below the first substrate layer within a predetermined space for transmitting and receiving signals to/from the first substrate layer; and (c) a signal transferring unit for allowing a rotation of the first substrate layer and transferring the signals between the first substrate layer and the second substrate layer, wherein the signal transferring unit is a coaxial cable and uses an electromagnetic coupling between the a super high signal transmission line of the first substrate layer and a super high signal transmission line of the second substrate layer; and a rotation operator for rotating the radiation elements with a predetermined angle.

23. The array antenna as recited in claim 22, wherein the super high frequency transmission line of the first substrate layer and the super high frequency transmission line of the second substrate layer have an identical type microstrip patch structure and a same size, and are arranged in a vertical overlapped position.

24. The array antenna as recited in claim 23, wherein the super high transmission line of the first substrate layer and the super high transmission line of the second substrate layer are a ring shape or a sliced ring shape.

* * * * *